US005275395A

United States Patent [19]

Boggiano et al.

[11] Patent Number: 5,275,395

[45] Date of Patent: Jan. 4, 1994

[54] UNIVERSAL GUIDE APPARATUS FOR INSERTER TRANSPORT

[75] Inventors: Bryan L. Boggiano, Milford; Alan B. Hotchkiss, Westport; Willis R. Stearns, Darien, all of Conn.

[73] Assignee: Pitney Bowes Inc., Stamford, Conn.

[21] Appl. No.: 996,267

[22] Filed: Dec. 24, 1992

[51] Int. Cl.[5] ..... B65H 7/02

[52] U.S. Cl. ..... 271/259; 271/265; 271/271; 271/274; 271/275; 198/836.2

[58] Field of Search ..... 271/258, 259, 233, 265, 271/271, 272, 273, 274, 277, 198, 197, 275, 276; 198/836.2

[56] References Cited

U.S. PATENT DOCUMENTS 5,094,306 3/1992 Cohen et al. ..... 177/145
5,098,511 3/1992 Barnes ..... 156/442.1
5,109,937 5/1992 Kipp ..... 177/145

FOREIGN PATENT DOCUMENTS 2327932 12/1974 Fed. Rep. of Germany ..... 271/274
3200364 7/1982 Fed. Rep. of Germany ..... 271/258
4-260547 9/1992 Japan ..... 271/273

*Primary Examiner*—H. Grant Skaggs
*Assistant Examiner*—Carol Lynn Druzbick
*Attorney, Agent, or Firm*—Charles R. Malandra, Jr.; Melvin J. Scolnick

[57] ABSTRACT

In an inserting machine, guide apparatus for maintaining control of individual sheets and collations that are conveyed along a transport deck by at least one pair of pushers, comprises a mounting beam coupled to a frame member of the inserting machine, and a plurality of guide arms pivotally mounted at one end to the mounting beam and biased against the transport deck. Each of the guide arms has a second end resting against the deck between the pair of pushers. Each of the guide arms has a curved shape for engaging a collation gradually An idler roller is rotatably mounted to the second end of each of the guide arms. The mounting beam is pivotally mounted at one end to the frame member of the inserting machine, whereby the other end of the guide apparatus is pivotable away from the transport deck.

5 Claims, 6 Drawing Sheets

UNIVERSAL GUIDE APPARATUS FOR INSERTER TRANSPORT

FIELD OF THE INVENTION

The invention disclosed herein relates generally to paper handling apparatus, and more particularly to inserting machines with a pusher type transport.

BACKGROUND OF THE INVENTION

In paper handling machines, single sheets and stacks of sheets can be transported a variety of ways. For example, it is known to use conveyors, belts or pushers to transport individual sheets or stacks of sheets. In some inserting machines, for example, the 8300 Series Inserting Machines manufactured by Pitney Bowes Inc. of Stamford, Conn., the pusher type transports are used for in-line assembly and insertion of a collation of documents and enclosures. Generally, some type of restraining device is used to keep the sheets and enclosures against the transport deck along which the pushers transport the documents. For example, brushes, wire guides, straps and combinations thereof have been used to prevent the documents being transported from raising above the top of the pusher devices.

One problem with the use of conventional restraining devices, such as brushes, wire guides, or straps, is that, typically, such devices or combinations thereof are suitable for certain applications, i.e., certain types of collations, but may require adjustment or reconfiguration if the application changes for the inserting machine. For example, one application may include several folded documents and one or two enclosures. Another application may include just one or two folded sheets but many enclosures, e.g., a checking account statement.

Another problem is that market demands have required a significant increase in the throughput of the inserting machines. As the speed of the inserting machines increases, the effectiveness of the restraining devices becomes more critical because, at the higher speeds, the documents are more likely to lift above the tops of the pushers. Furthermore, when conventional restraining devices are used on collations being transported at such high speeds, the collations tend to shift, i.e., lose collation integrity, when the pusher transport coasts to a stop.

Although conventional restraining devices are adequate, an improved transport restraining device is desired that will improve the performance at such high speeds.

It is an object of the present invention to provide an improved transport restraining device that is suitable for handling any size sheet or enclosure being transported at high speeds.

It is a further object of the present invention to provide an improved transport restraining device that provides jam detection and easy jam access.

It is a another object of the present invention to provide a universal transport restraining device that will handle any size collation without the need for adjustment or reconfiguration.

SUMMARY OF THE INVENTION

It has been found that the present invention improves paper handling and control in pusher pin type transports by maintaining the paper down on the paper contact surface, maintaining the collation integrity during a coast down condition, and keeping the collation compressed regardless of the size of the documents in the collation.

In accordance with the present invention, guide apparatus for maintaining control of individual sheets and collations that are conveyed along a transport deck by at least one pair of pushers, comprises a mounting beam coupled to a frame member of the inserting machine, and a plurality of guide arms pivotally mounted at one end to the mounting beam and biased against the transport deck. Each of the guide arms has a second end resting against the deck between the pair of pushers. Each of the guide arms has a curved shape for engaging a collation gradually An idler roller is rotatably mounted to the second end of each of the guide arms. The mounting beam is pivotally mounted at one end to the frame member of the inserting machine, whereby the other end of the guide apparatus is pivotable away from the transport deck. The guide apparatus also includes sensing means, such as a light source and an optical sensor, for detecting paper jams.

DETAILED DESCRIPTION OF THE PRESENT INVENTION

Referring now to the figures, there is shown alternate embodiments of a paper guide, generally designated 10, having a plurality of curved arms which are spring-loaded against a transport deck. Paper guide 10 is shown as part of a transport system that includes a conventional pusher transport, generally designated 5, including pushers 7. The preferred embodiment of the present invention, shown in FIGS. 1-5, includes jam access and optical jam detection. The alternate embodiment, shown in FIGS. 6-9, includes a mechanical jam detection.

Figure 1:
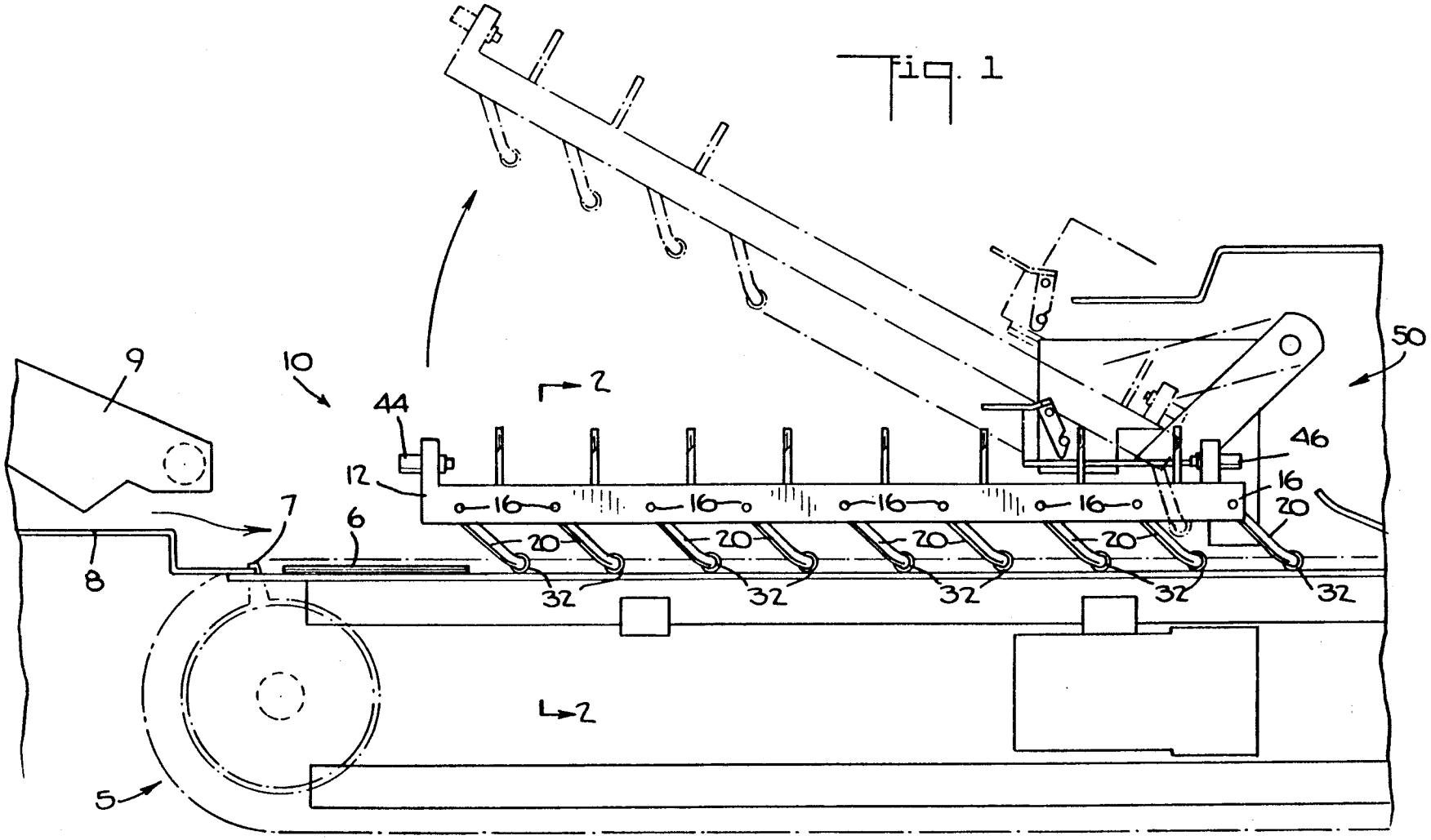
FIG. 1 is a side elevational view of the guide apparatus in accordance with the present invention.
Figure 2:
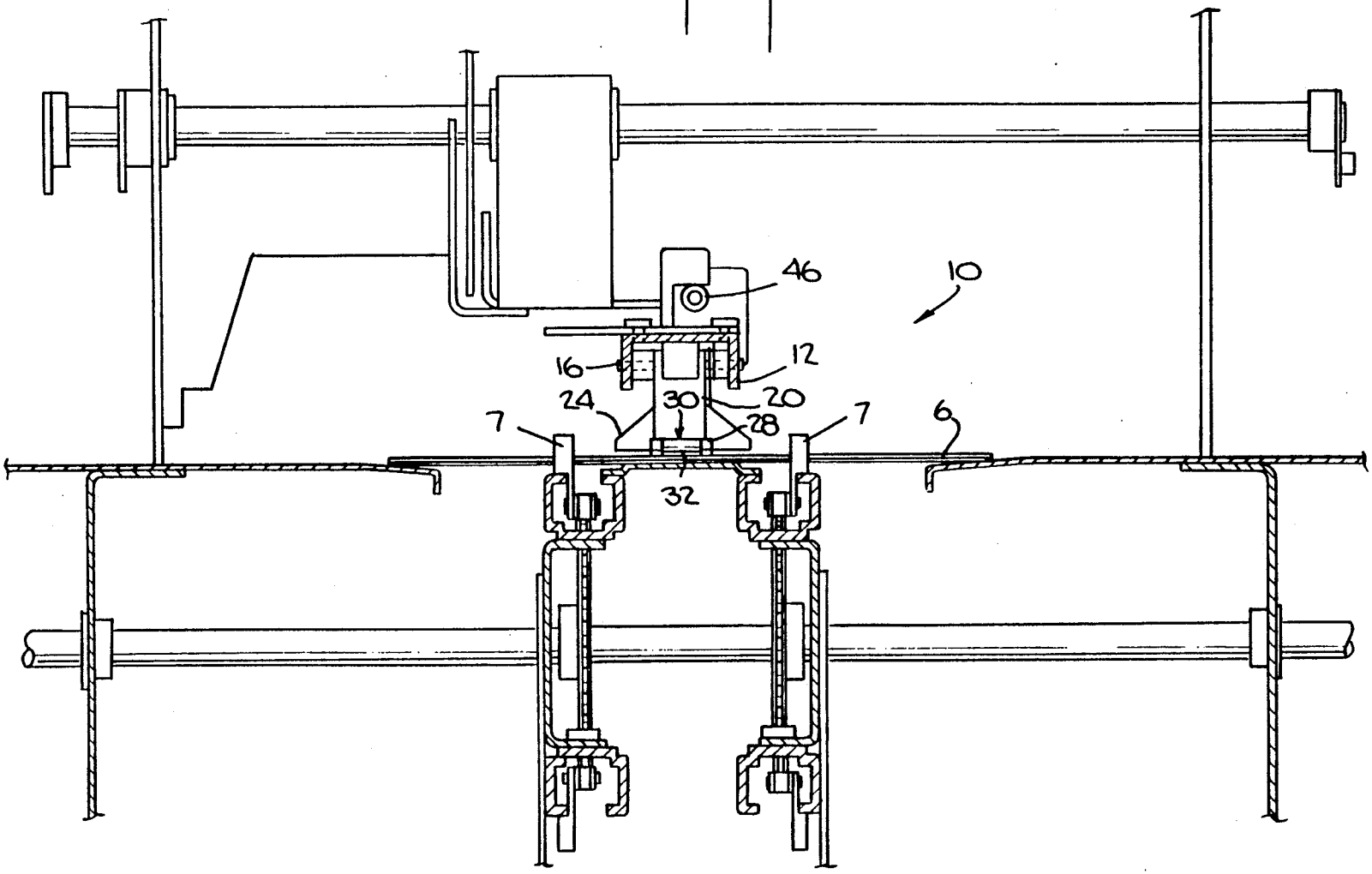
FIG. 2 is an end view of the guide apparatus of FIG. 1 taken along the line 2—2 in FIG. 1.

In FIG. 1, paper guide 10 is shown in a normal resting position, i.e., before collation 6 is engaged. In FIG. 2, paper guide 10 is in a loaded position, i.e., a collation 6 is passing thereunder. In FIG. 1, collation 6 is conveyed to paper guide 10 along a transport deck 8 by a conventional pusher transport (not shown). A feeding station 9 is shown for feeding enclosures onto collation 6 before collation 6 is engaged by pushers 7 and conveyed to paper guide 10.

Figure 3:
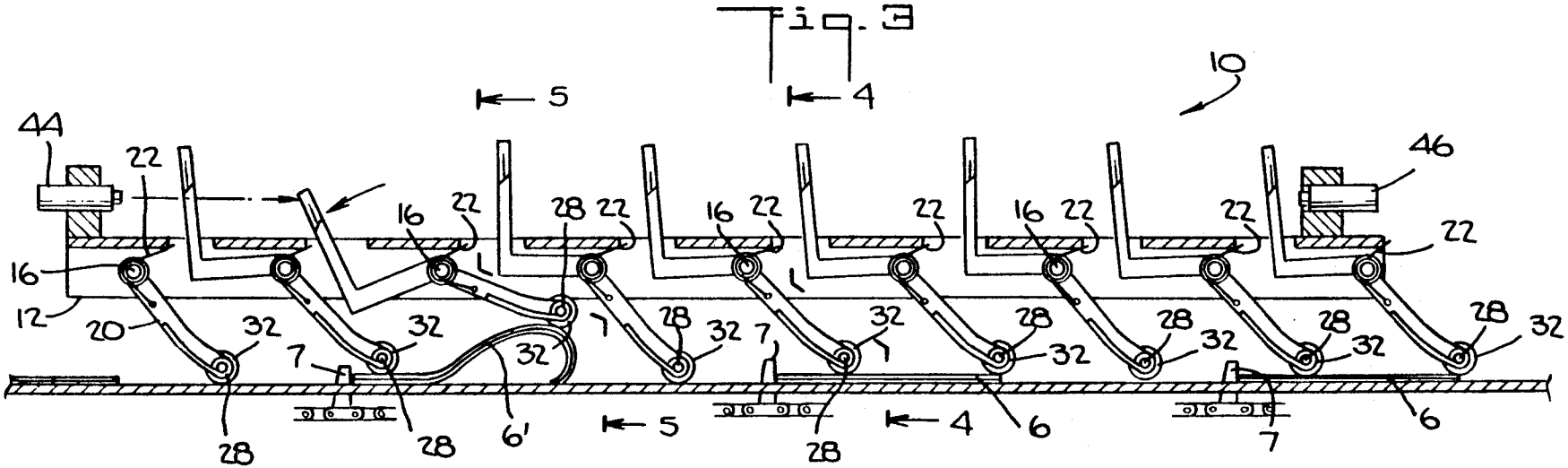
FIG. 3 is a side elevational view of the guide apparatus of FIG. 1 showing jam detection.

Paper guide 10 includes a U-shaped mounting beam 12 to which a plurality of pins 16 are suitably journaled to side members thereof. Each pin 16 has an arm 20 rigidly supported thereon. There is a spring member 22 (FIG. 3) between each pin 16 and arm 20 combination to bias arms 20 in a clockwise direction, as seen in FIGS. 1 and 3. The lower portion of arms 20 form skis 24, and each of skis 24 has a pin 28 conventionally journaled through an opening, generally designated 30, at the lower center of skis 24. An idler roller 32 is located in opening 30 and is rotatably supported by pin 28.

Figure 5:
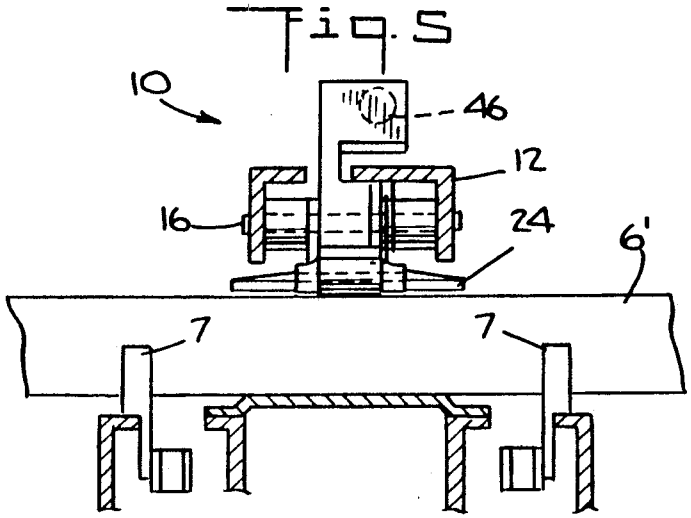
FIG. 5 is an end view of the guide apparatus taken along the line 5—5 in FIG. 3.

An upper arm member 40 is rigidly coupled to each arm 20 about pin 16 such that upper arm member 40 pivots with arm 20. Each upper arm member 40 extends above mounting beam 12. There is a optical sensor system comprising a light source 44 mounted at one end of mounting beam 12 and an optical detector 46 mounted at the other end of beam 12. Each upper arm member 40 has a cut out section 48 through which a beam of light from light source 44 passes to optical detector 46 during normal operation of paper guide 10, as shown in FIG. 5.

As collation 6 makes contact with each of arms 20 of paper guide 10, the respective arm 20 is pivotally deflected in a radius about pin 16. The curvature of arms 20 provides a gradual contact with collation 6 as each arm 20 engages the collation. Idler rollers 32 allow collation 6 to roll under arms 20, rather than arms 20 dragging across the top sheet of the collation. This feature prevents the top sheet from being excessively restrained causing the top sheet to buckle or to lift over the top of pusher pins 7. Spring member 22 provides a spring load to arms 20 which is suitable for handling individual sheets equally as well as collations of multiple sheets and enclosures. In the preferred embodiment, spring member 22 is a torsion spring having a developed torque of approximately 0.187 in-lb, a wire diameter of 0.020 inches and a free form bend of 270 degrees.

A plurality of arms 20 are spaced a fixed distance apart so that the shortest enclosure or document in a collation is always in the control of at least one of the arms at a time while being transported by conventional pusher drive 7 under paper guide 10. Such spacing of the plurality of arms 20 provides continuous control of collations of varying thickness, even during pusher 7 coast down from high speed operation. In the preferred embodiment 30 of the present invention, arms 20 are spaced—inches apart.

Figure 4:
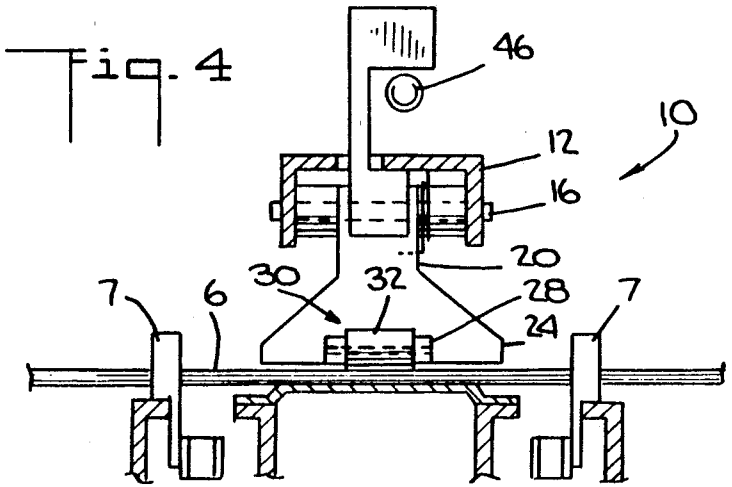
FIG. 4 is an end view of the guide apparatus taken along the line 4—4 in FIG. 3.
Figure 6:
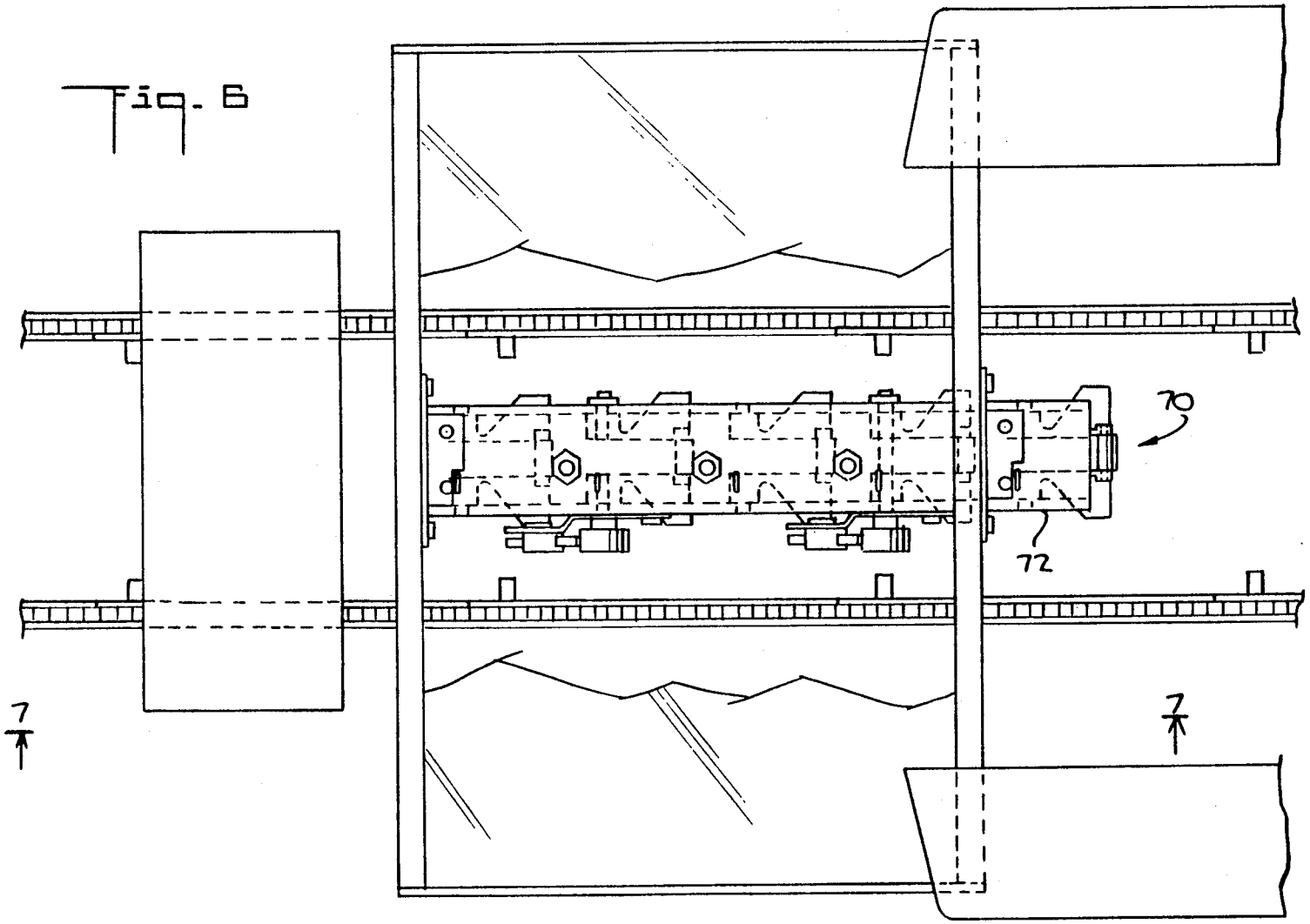
FIG. 6 is a plan view of an alternate embodiment of the guide apparatus in accordance with the present invention.
Figure 7:
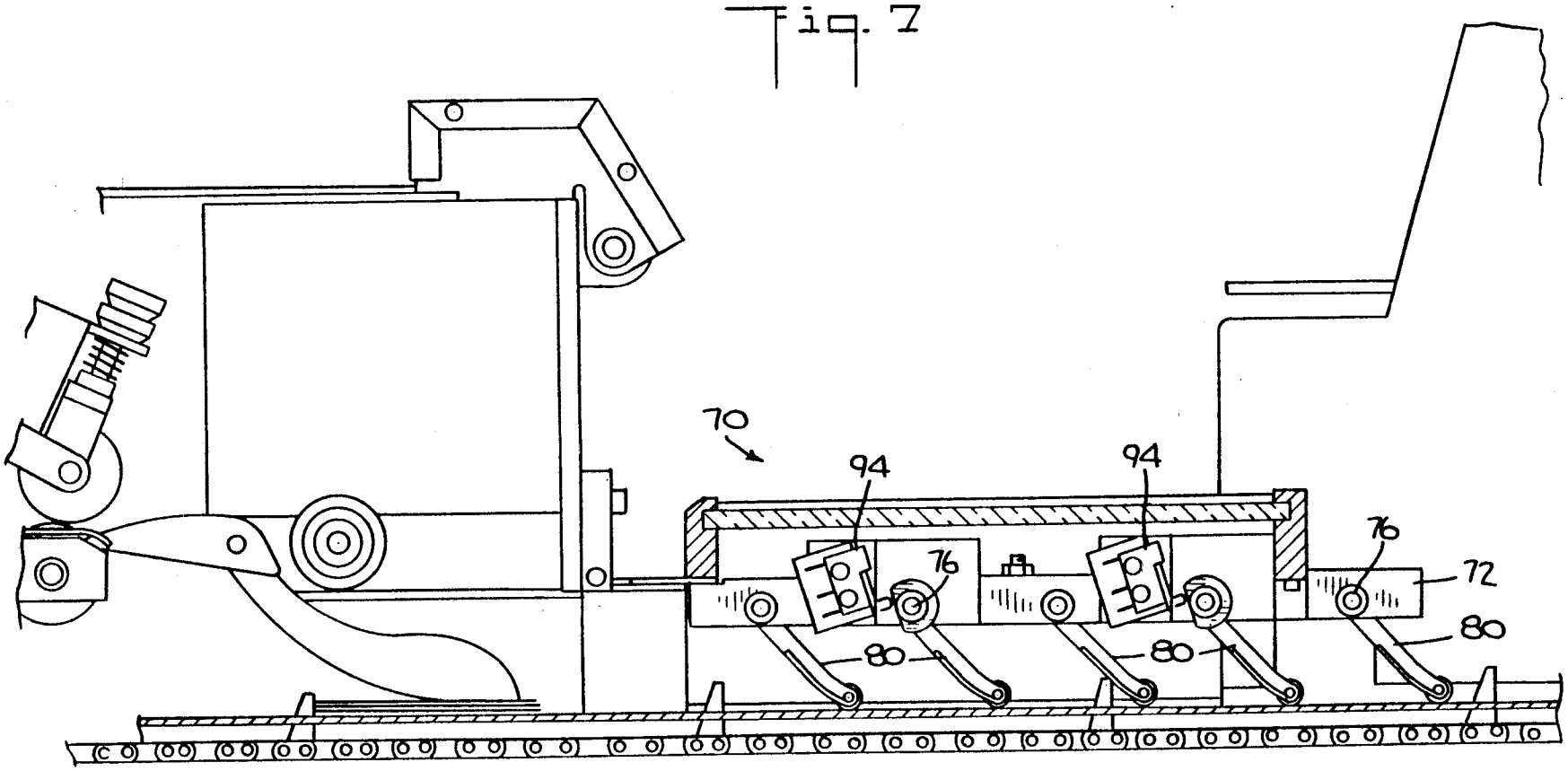
FIG. 7 is a side elevational view of the guide apparatus of FIG. 6.
Figure 9:
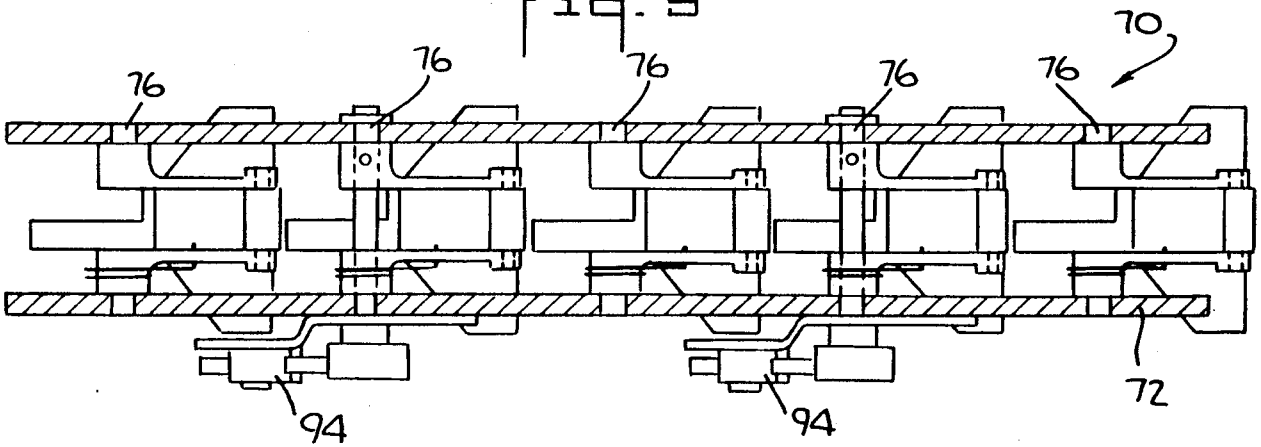
FIG. 9 is a plan view of the guide apparatus taken along the line 9—9 in FIG. 8.

Referring now to FIGS. 3 and 4, when a jam occurs for collation 6', one or more of arms 20 pivot beyond a normal operating position for guiding collations causing the corresponding ones of upper arm members 40 to block the light beam from light source 44 such that optical detector 46 fails to sense the light beam. In this manner, a jam is detected, and the operating system stops the transport system 5 and provides a signal to an operator that a jam has been detected. Referring again to FIG. 1, paper guide 10 is pivotally mounted to a frame member, generally designated 50, in a conventional manner whereby paper guide 10 can be pivoted up for removal of the jam.

Figure 8:
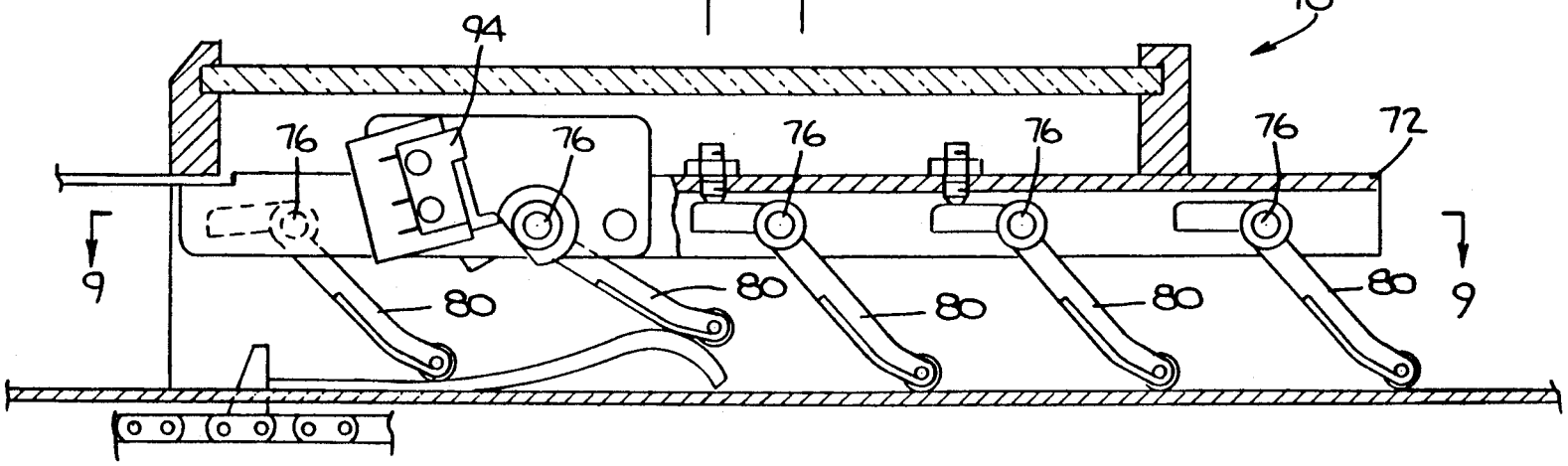
FIG. 8 is a side elevational of the guide apparatus of FIG. 6 showing jam detection.

Referring now to FIGS. 6–9, there is shown an alternate embodiment of the present invention. A paper guide, generally designated 70, includes a similar, but shorter, U-shaped mounting beam 72 to which a plurality of pins 76 are suitably journaled for pivotally supporting an arm 80. A spring member (not shown) is coupled to each pin 76 and arm 80 combination to bias arms 80 in a clockwise direction, as in the preferred embodiment. The lower portion of arms 80 form skis 84, and each of skis 84 has a pin 88 conventionally journaled through an opening at the lower center of skis 84. An idler roller 92 is located in the opening and is rotatably supported by pin 88. There is at least one conventional mechanical switch 94 mounted to mounting beam 72 for detecting paper jams, as shown in FIG. 8. A D-shaped washer is rigidly mounted to one end of pin 76 adjacent to mechanical switch 94 such that mechanical switch 94 is activated when the adjacent arm 80 pivots beyond a normal operating position, thus indicating a jam has been detected. An example of the mechanical switch used is part number E61-77HB manufactured by Cherry Electrical Products Corporation of Waukegan, Ill.

While the present invention has been disclosed and described with reference to a single embodiment thereof, it will be apparent, as noted above that variations and modifications may be made therein. It is, thus, intended in the following claims to plate each variation and modification that falls within the true spirit and scope of the present invention.

What is claimed is:

1. In an inserting machine, guide apparatus for maintaining control of individual sheets and collations that are conveyed along a transport deck by at least one pair of pushers, comprising:

a mounting beam coupled to a frame member of the inserting machine;

a plurality of guide arms pivotally mounted at one end to said mounting beam and biased against the transport deck, each of said guide arms having a second end resting against said deck between the pair of pushers, each of said guide arms having a curved shape for engaging a collation gradually;

an idler roller rotatably mounted to said second end of each of said guide arms; and sensing means for detecting paper jams mounted on said mounting beam.

2. The guide apparatus of claim 1 wherein said mounting beam is pivotally mounted at one end to the frame member of the inserting machine, whereby the other end of said guide apparatus is pivotable away from the transport deck.

3. The guide apparatus of claim 1 wherein said sensing means includes a light source and an optical sensor for detecting paper jams and a means for interrupting said light source.

4. The guide apparatus of claim 3 wherein said means for interrupting said light source is a second arm rigidly coupled to each of said guide arms, said second arm extending above said mounting beam and said second arm having a cut out section through which an optical beam from said light source passes during normal operation of said guide means, and a solid section above said cut out section, said solid section of said second arm blocking said optical beam when a corresponding one of said guide arms pivots beyond a normal operating tolerance which suggests a jam has occurred.

5. The guide apparatus of claim 1 wherein said sensing means includes at least one mechanical switch operatively coupled to an adjacent one of said guide arms.

* * * * *